US008727232B2

(12) United States Patent
Kronsteiner

(10) Patent No.: US 8,727,232 B2
(45) Date of Patent: May 20, 2014

(54) CENTRIFUGAL ATOMIZER

(76) Inventor: Martin Kronsteiner, Vienna (AT)

( * ) Notice: Subject to any disclaimer, the term of this patent is extended or adjusted under 35 U.S.C. 154(b) by 629 days.

(21) Appl. No.: 12/988,876

(22) PCT Filed: Apr. 16, 2009

(86) PCT No.: PCT/EP2009/002786

§ 371 (c)(1),
(2), (4) Date: Jan. 13, 2011

(87) PCT Pub. No.: WO2009/129961

PCT Pub. Date: Oct. 29, 2009

(65) Prior Publication Data

US 2011/0101126 A1 May 5, 2011

(30) Foreign Application Priority Data

Apr. 21, 2008 (AT) ..... A 631/2008

(51) Int. Cl.

| | |
|---|---|
| ***B05B 17/04*** | (2006.01) |
| ***B05B 3/10*** | (2006.01) |
| ***B05B 5/10*** | (2006.01) |
| ***F23D 11/04*** | (2006.01) |

(52) U.S. Cl.
USPC ..... 239/7; 239/222.11; 239/223; 239/224; 239/263.1; 169/46

(58) Field of Classification Search
USPC ..... 239/222.11, 222.17, 223, 224, 263.1, 239/263.3, 7; 169/51, 52, 53, 54, 56, 57, 169/74, 89, 46
See application file for complete search history.

(56) References Cited

U.S. PATENT DOCUMENTS

| | | | | |
|---|---|---|---|---|
| 1,853,682 | A * | 4/1932 | Hechenbleikner | 239/223 |
| 2,724,614 | A | 11/1955 | Rider | |
| 3,749,315 | A | 7/1973 | Crathern | |
| 4,444,547 | A * | 4/1984 | Stolz | 417/46 |
| 5,143,657 | A * | 9/1992 | Curtis | 239/224 |
| 5,152,458 | A * | 10/1992 | Curtis | 239/224 |
| 5,936,531 | A * | 8/1999 | Powers | 340/628 |
| 7,041,173 | B2 * | 5/2006 | Merabet | 118/323 |
| 7,131,601 | B2 * | 11/2006 | Nolte et al. | 239/224 |
| 2002/0148908 | A1 | 10/2002 | Linstedt et al. | |
| 2004/0244106 | A1 * | 12/2004 | Chesters | 4/620 |
| 2006/0065760 | A1 | 3/2006 | Micheli | |
| 2007/0295166 | A1 * | 12/2007 | Sanui et al. | 75/602 |
| 2008/0048050 | A1 | 2/2008 | Mazooji et al. | |

FOREIGN PATENT DOCUMENTS

| | | |
|---|---|---|
| EP | 0 271 589 A1 | 6/1988 |
| WO | 0053333 A1 | 9/2000 |

* cited by examiner

*Primary Examiner* — Ryan Reis
(74) *Attorney, Agent, or Firm* — Laurence A. Greenberg; Werner H. Stemer; Ralph E. Locher

(57) ABSTRACT

A discharging device for safety-related fluids, such as liquid solutions of irritants such as Oleoresin Capsicum, riot control and self-defense agents such as a combination of (E)-2-butenyl mercaptan (C4H7SH), 3-methyl butanethiol and corresponding S-acetyl compounds, marking agents such as dyes and fluorescent pigments, combinations of the same, and extinguishing agents for fire fighting and early fire fighting such as 1,1,1,2,2,4,5,5,5-nonafluoro-4-(trifluoromethyl)-3-pentanone, in particular in technical equipment such as switchgear cabinets. The device has a valve connected to a safety-related fluid source. The valve leads to a distributor having discharge openings. The distributor is a driven atomization wheel.

11 Claims, 8 Drawing Sheets

CENTRIFUGAL ATOMIZER

BACKGROUND OF THE INVENTION

Field of the Invention

The invention relates to a discharge appliance for safety liquids, such as liquid solutions of irritants, such as oleoresin capsicum, riot control and self-defense agents, such as a combination of (E)-2-butenylmercaptan (C4H7SH), 3-methylbutanthiol and the corresponding S-acetyl compounds, markers, such as dyes and fluorescent pigments, combinations of the aforesaid and extinguishing agents for fire fighting and preventive fire fighting, such as 1,1,1,2,2,4,5,5,5-nonafluoro-4-(triflouromethyl)-3-pentanone, known as Novec™ 1230 from 3M™, particularly in technical equipment, such as, for example, switch cabinets, with a valve which is connected to a safety liquid source and which issues into a distributor having discharge orifices. Furthermore, the discharge appliance may also contain a control device for releasing the safety liquid.

In order to build up a specific concentration of safety liquid in an appropriate period of time, nozzles for the most diverse possible types of construction are used in the present time, to which the safety liquid is supplied by means of a pressurized pipeline system. In this method, there is a disadvantage that the particle size of the safety liquid mist and the discharge time of the safety liquid rise with a falling system pressure. To achieve the necessary pressure, at the present time, on the one hand, various propellants, such as $CO_2$, argon, $N_2$, etc., which have to be stored in pressure vessels in an appropriate quantity and under appropriate pressure, and, on the other hand, pressure-increasing pumps are employed.

BRIEF SUMMARY OF THE INVENTION

The object of the present invention is to provide a discharge appliance, by means of which safety liquid can be discharged, if possible without the use of propellants or pressure-increasing pumps, and can be atomized, at the same time with rapid evaporation and with the least possible droplet flight distances, and by means of which the required concentration of safety liquid can be built up quickly.

The object is achieved by means of a discharge appliance of the type initially mentioned, in which the distributor is a drivable atomizer wheel.

As a result of the rotation of the atomizer wheel, the safety wheel is flung away, and a vacuum is generated which sucks the safety liquid from the safety liquid source, for example out of a storage container.

Preferably, the safety liquid source is connected to the atomizer wheel via a liquid duct in the valve, and the valve has an air inlet duct which is sealed off with respect to the liquid duct. Air can continue to flow through the air inlet duct to the safety liquid source, and pressure equalization becomes possible. Owing to the use of the atomizer wheel, the safety liquid is accelerated by centrifugal force and is introduced as high velocity into the ambient atmosphere. A rapid uniform increase in the safety liquid concentration in the ambient atmosphere thereby takes place.

In order to achieve better atomization and better intermixing of safety liquid and air, a baffle surface, which is preferably inclined with respect to the axial rotation of the atomizer wheel, is advantageously provided around the circumference of the atomizer wheel.

Preferably, the valve is a slide valve with a valve piston and with a valve body, which, in the closed state, closes the safety liquid outlet duct and the air inlet duct and, in the open state, connects the safety liquid outlet duct to the atomizer wheel and connects the air inlet duct to the atmosphere. The slide valve, while having high leaktightness, can be actuated in a simple way mechanically, electrically, electromechanically, pneumatically, hydraulically or pyrotechnically.

In the atomizer wheel, a run-on element may be provided, which cooperates with a run-on surface on the valve piston, in order to displace the latter during the rotation of the atomizer wheel. Thus, as a result of the rotation of the atomizer wheel, not only can the safety liquid be discharged and the required vacuum generated, but the valve can also be opened.

In a preferred embodiment, the atomizer wheel contains a release element with a claw function, which cooperates with a clearance on the valve piston, in order to displace the latter by spring force during the rotation of the atomizer wheel. Thus, as a result of the rotation of the atomizer wheel, not only can the safety liquid be discharged and the required vacuum generated, but the valve can also be opened.

In a preferred embodiment, the discharge appliance according to the invention contains an electric motor for rotating the atomizer wheel.

In a preferred embodiment, the discharge appliance according to the invention contains a safety liquid filling-level monitoring device.

In the preferred embodiment, the safety liquid used is the extinguishing agent Novec™ 1230 from 3M™.

In the preferred embodiment, the safety liquid which may be used is a liquid solution of irritants, such as oleoresin capsicum, riot control and self-defense agents, such as a combination of (E)-2-butenylmercaptan (C4H7SH), 3-methylbutanthiol and the corresponding S-acetyl compounds, markers, such as dyes and fluorescent pigments, or a combination of the aforesaid.

BRIEF DESCRIPTION OF THE SEVERAL VIEWS OF THE DRAWING

The invention is described and explained below with reference to an exemplary embodiment illustrated in the accompanying drawings in which.

DESCRIPTION OF THE INVENTION

Figure 1:
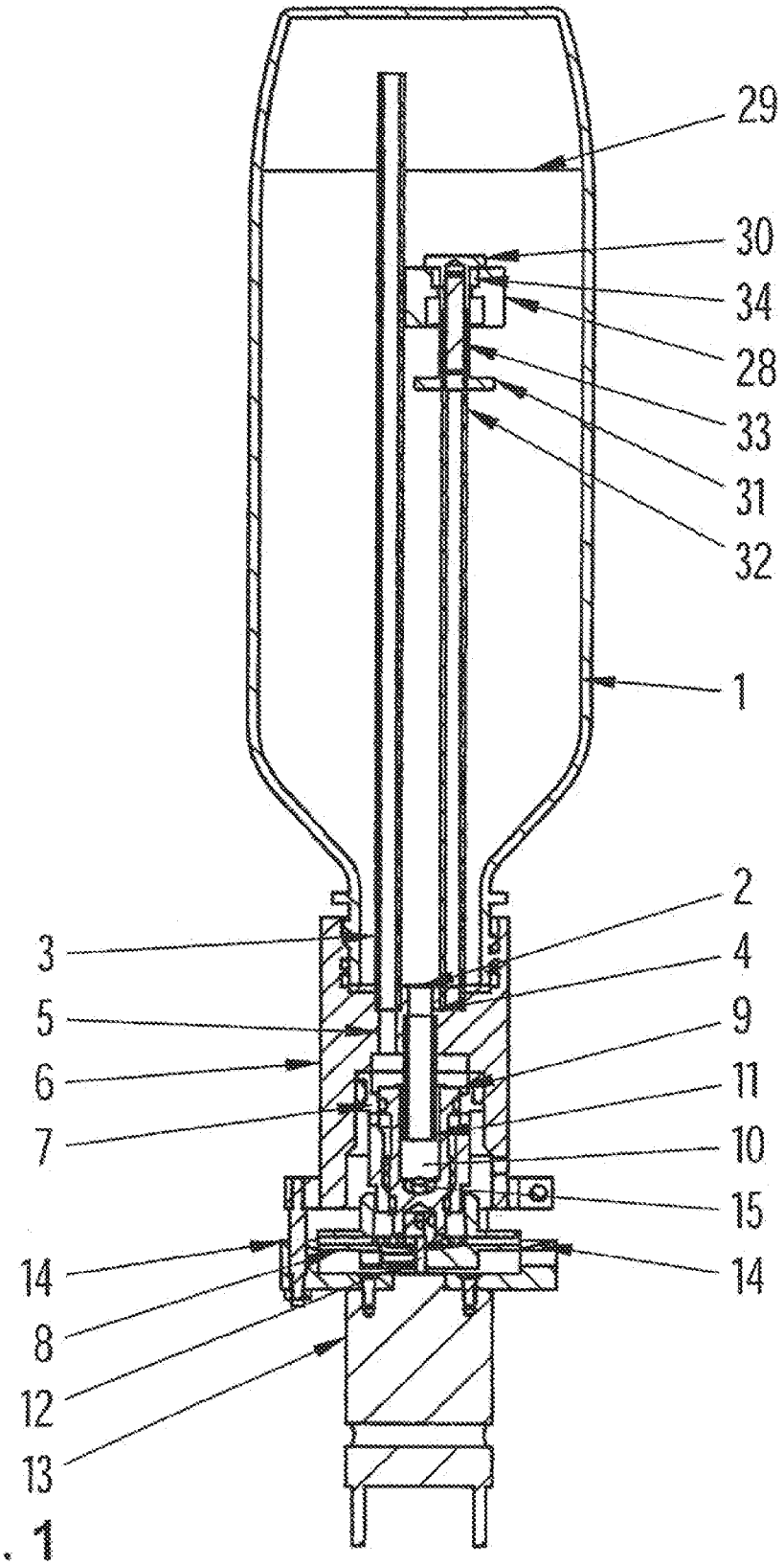
FIG. 1: illustrates a discharge appliance according to the invention with safety liquid filling-level monitoring, and with a storage container for the safety liquid, in the filled state, with the valve closed, in a vertical sectional illustration.
Figure 2:
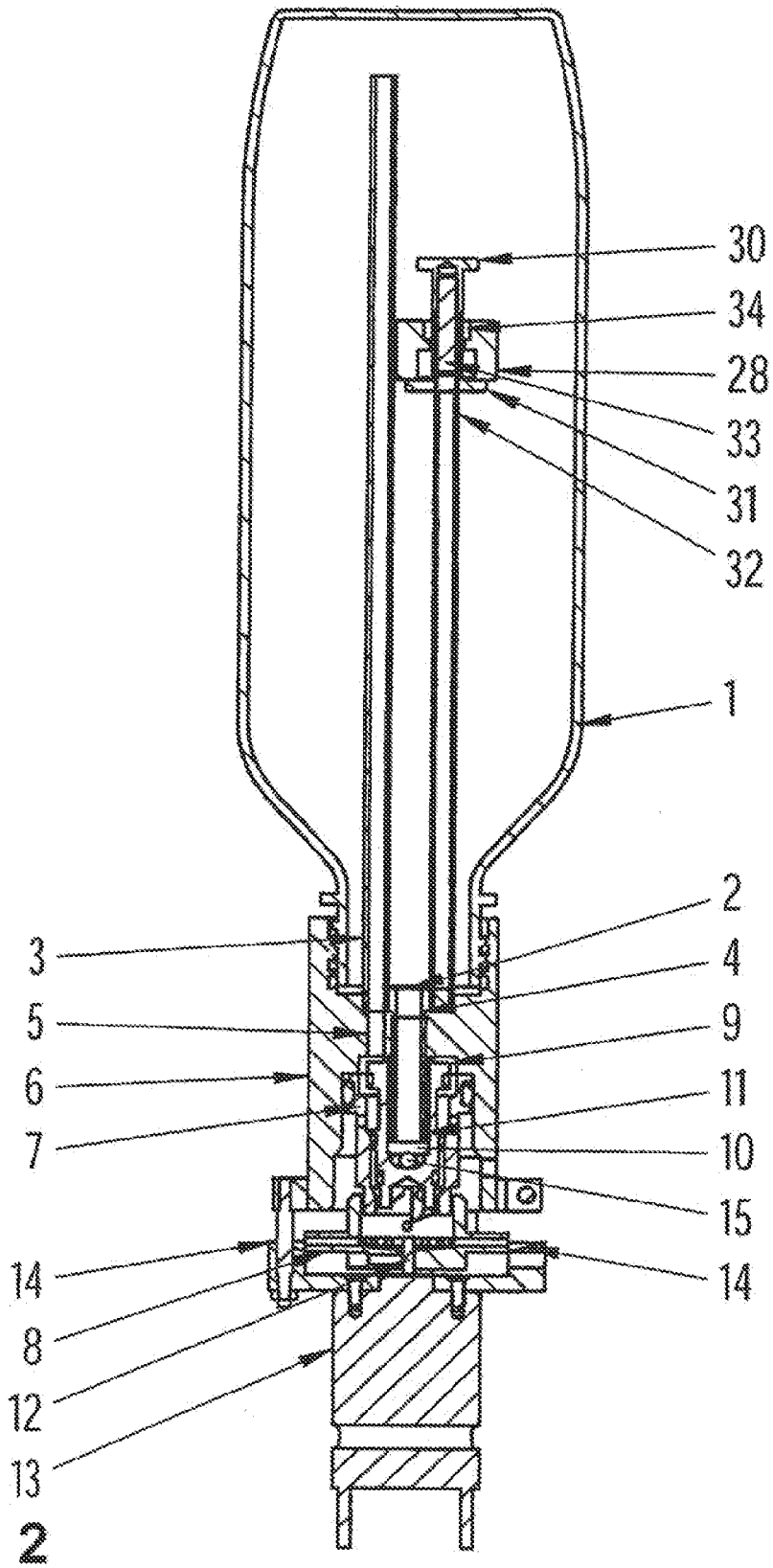
FIG. 2: illustrates the discharge appliance from FIG. 1, with the valve open and the storage container emptied.
Figure 3:
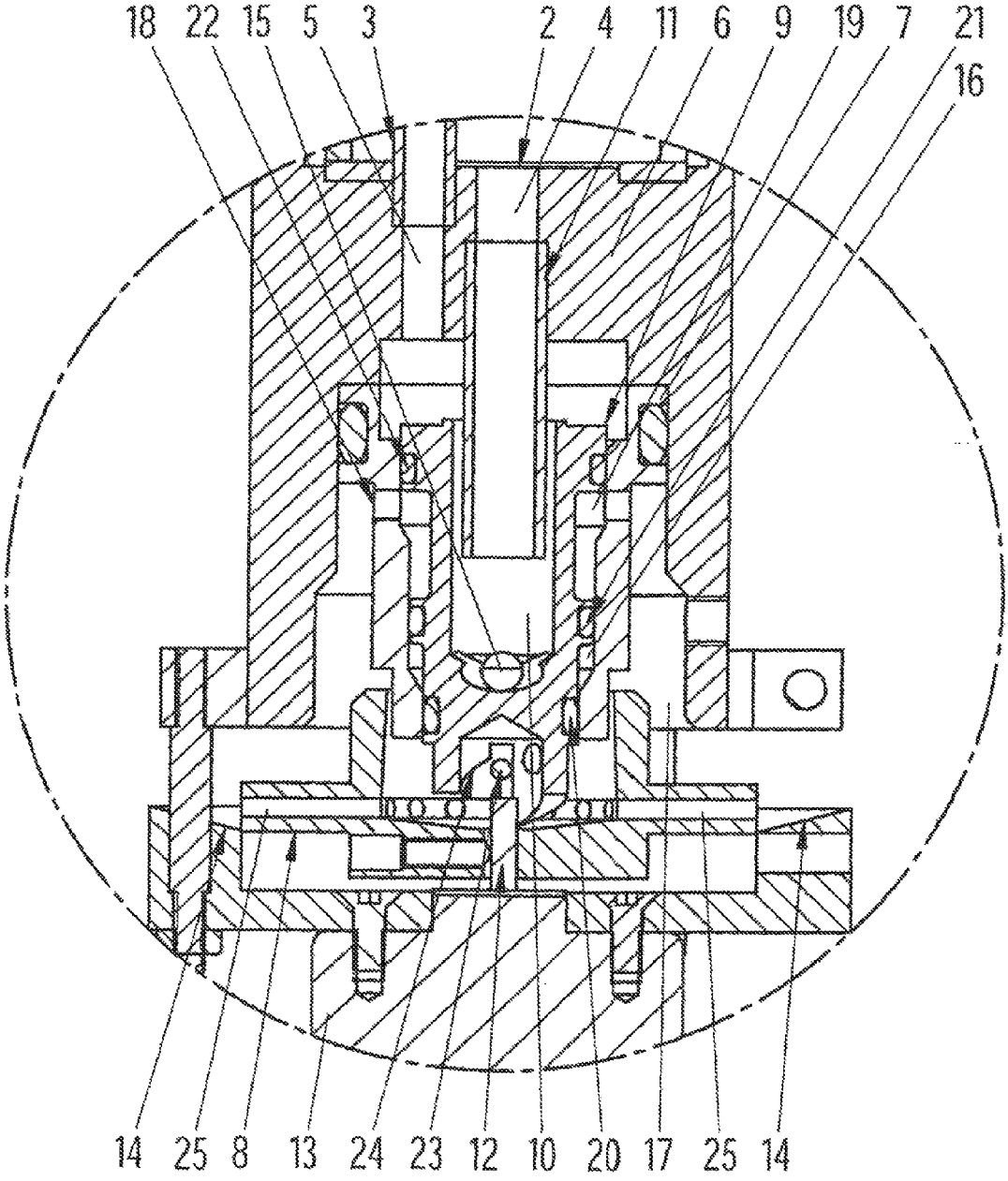
FIG. 3: illustrates an enlarged detail from FIG. 1 in the region of the valve.
Figure 4:
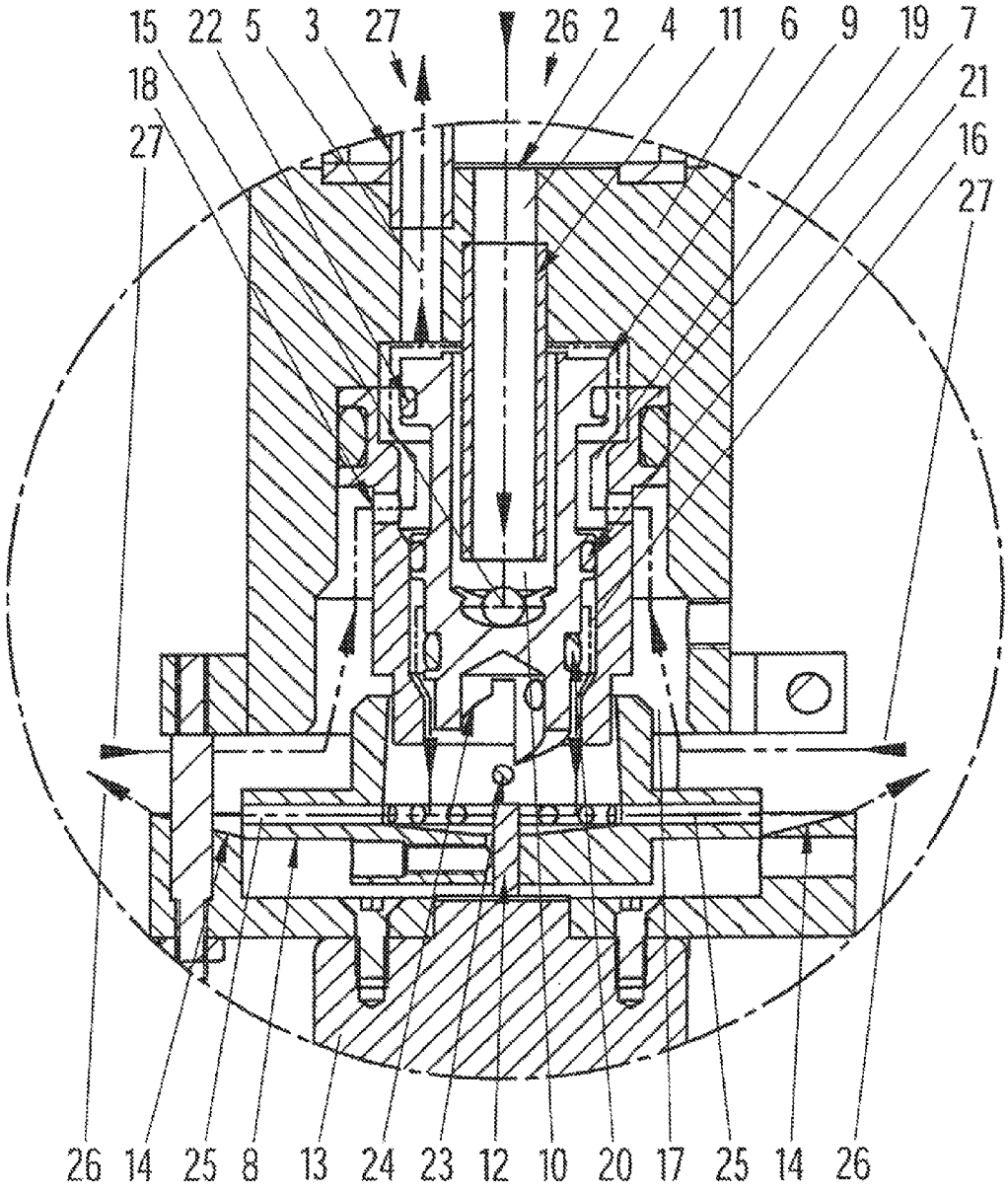
FIG. 4: shows an enlarged detail from FIG. 2 in the region of the valve.

In the exemplary embodiment illustrated in FIG. 1 to FIG. 4, the storage container 1 is in the form of a bottle which has a safety liquid outlet orifice 2 and an air inlet tube 3 separate from the latter. The safety liquid outlet orifice 2 and the air inlet tube 3 issue into separate bores 4, 5 in the valve housing 6 which is screwed onto the bottle neck. Inserted into the valve housing 6 is a valve sleeve 7 which is sealed off at its tank-side end with respect to the valve housing 6 and which issues at its end facing away from the storage container 1 into an atomizer wheel 8. Arranged displaceably in the valve sleeve 7 is a valve piston 9 having a central bore 10 into which projects a safety liquid tube 11 prolonging the bore 4 for safety liquid in the valve housing 6. The shaft 12 of the atomizer wheel 8 is driven by an electric motor 13. A baffle surface 14 which is inclined with respect to a longitudinal axis of the valve is provided around the circumference of the atomizer wheel 8. Further, a filling-level monitoring tube 32 is fastened sealingly to the valve housing 6 on the safety liquid filling-level monitoring and has an upper and a lower float stop 30, 31 at the upper end facing away from the valve housing 6. Inside the filling-level monitoring tube 32, a reed contact 33 is mounted, which switches by means of the magnet 34 during the lowering of the coaxial float 28. FIG. 1 illustrates the safety liquid level 29 above the safety liquid filling-level monitoring device. FIG. 2 illustrates an emptied storage container.

When the valve is in the open state (see FIG. 4), the safety liquid passes from the storage container 1 through the safety liquid outlet orifice 2 into the bore 4 in the valve housing 6 and through the safety liquid tube 11 into the central bore 10 of the valve piston 9. It passes from the central bore 10 through radial bores 15 into the space 16 between the valve piston 9 and the valve sleeve 7, which space communicates with an inner space of the atomizer wheel 8 when the valve is in the open state. The path of a safety liquid which is described and which is illustrated by the arrowed line 26 in FIG. 4 forms the liquid duct of the valve. Air simultaneously passes through an air orifice 17 in the valve housing 6 and a perforation 18 in the valve sleeve 7 into a space 19 between the valve sleeve 7 and the valve piston 9, which space communicates, in the open state of the valve, with the bore 5 for air in the valve housing 6 and consequently with the air inlet tube 3 and the interior of the storage container 1. The path of the air which is described and which is illustrated by the arrowed line 27 in FIG. 4 forms the air inlet duct. The liquid duct and the air inlet duct are separated from one another by the O-ring 21, so that, during use, the safety liquid can be extracted from the storage container and the storage container can be ventilated at the same time, so that the safety liquid quantity per unit time can be kept approximately constant while the safety liquid is being discharged.

In the closed state of the valve (see FIG. 3), the space 16 between the valve piston 9 and the valve sleeve 7 is closed by the O-rings 20 and 21 and communicates only with the radial bores 15, so that no safety liquid can pass out of the liquid duct into the inner space of the atomizer wheel 8. At the same time, the space 19 between the valve piston 9 and the valve sleeve 7 is closed by the O-rings 21 and 22 and communicates only with the perforation 18 in the valve sleeve 7, so that no air can pass through the air inlet duct into the air inlet tube 3 and consequently into the storage container 1. The position of the valve piston 9 with respect to the valve sleeve 7 ensures a permanently leaktight closure of the storage container 1.

In the discharge appliance according to the invention, as illustrated, the valve designed as a slide valve can be displaced from its closed position (FIG. 3) into its open position (FIG. 4) by the electric motor 13. In the event of a fire, the electric motor 13, activated, for example, by a control unit which has received a signal from a fire detection device, sets the atomizer wheel 8 in rotation. In the inner space of the atomizer wheel, a radial pin 23 is provided which serves as a run-on element for a run-on surface 24 on the valve piston 9. During the rotation of the atomizer wheel 8, the run-on surface 24 of the valve piston 9 runs on the pin 23, and the valve piston 9 is displaced in the direction of the storage container 1 with respect to the valve sleeve 7 until it is in the open position (FIG. 4) in which the O-rings 20 and 22 lying on the circumference of the valve piston 9 are no longer in contact with the valve sleeve 7 and in which the liquid duct 26 and the air inlet duct 27 are therefore open. The safety liquid can therefore flow from the space 16 into the inner space of the atomizer wheel 8 and from there radially outward through the discharge orifices 25. The centrifugal force generated as a result of the rotation of the atomizer wheel 8 gives rise to a vacuum and sucks safety liquid out of the storage container 1. The safety liquid emerging from the discharge orifices 25 is atomized further as a result of impingement upon the baffle surface 14. At the same time, air can continue to flow through the air inlet duct into the storage container 1.

Figure 5:
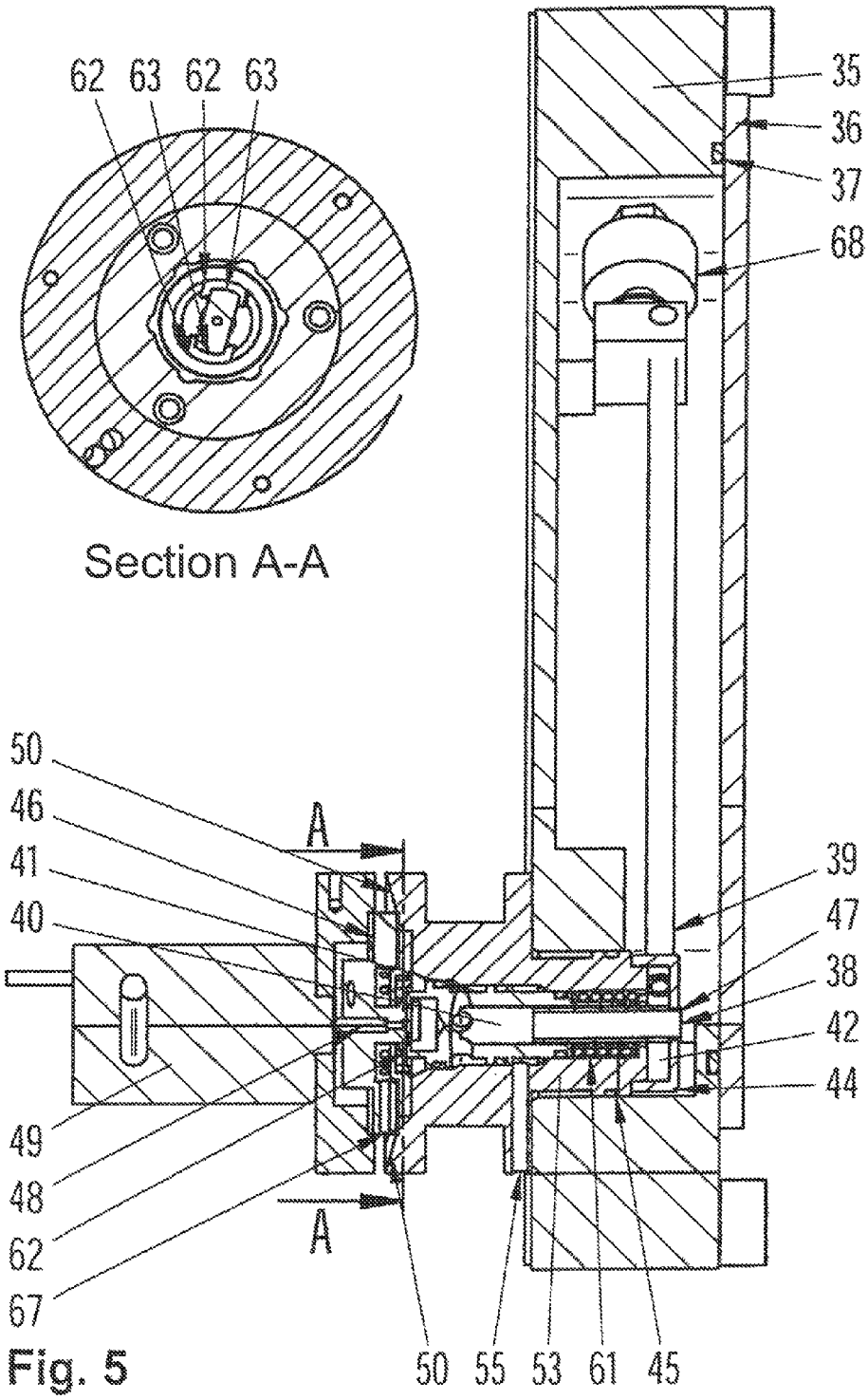
FIG. 5: shows a discharge appliance according to the invention with safety liquid filling-level monitoring and with a storage container for the safety liquid, in the filled state, with the valve closed, in the vertical sectional illustration.
Figure 6:
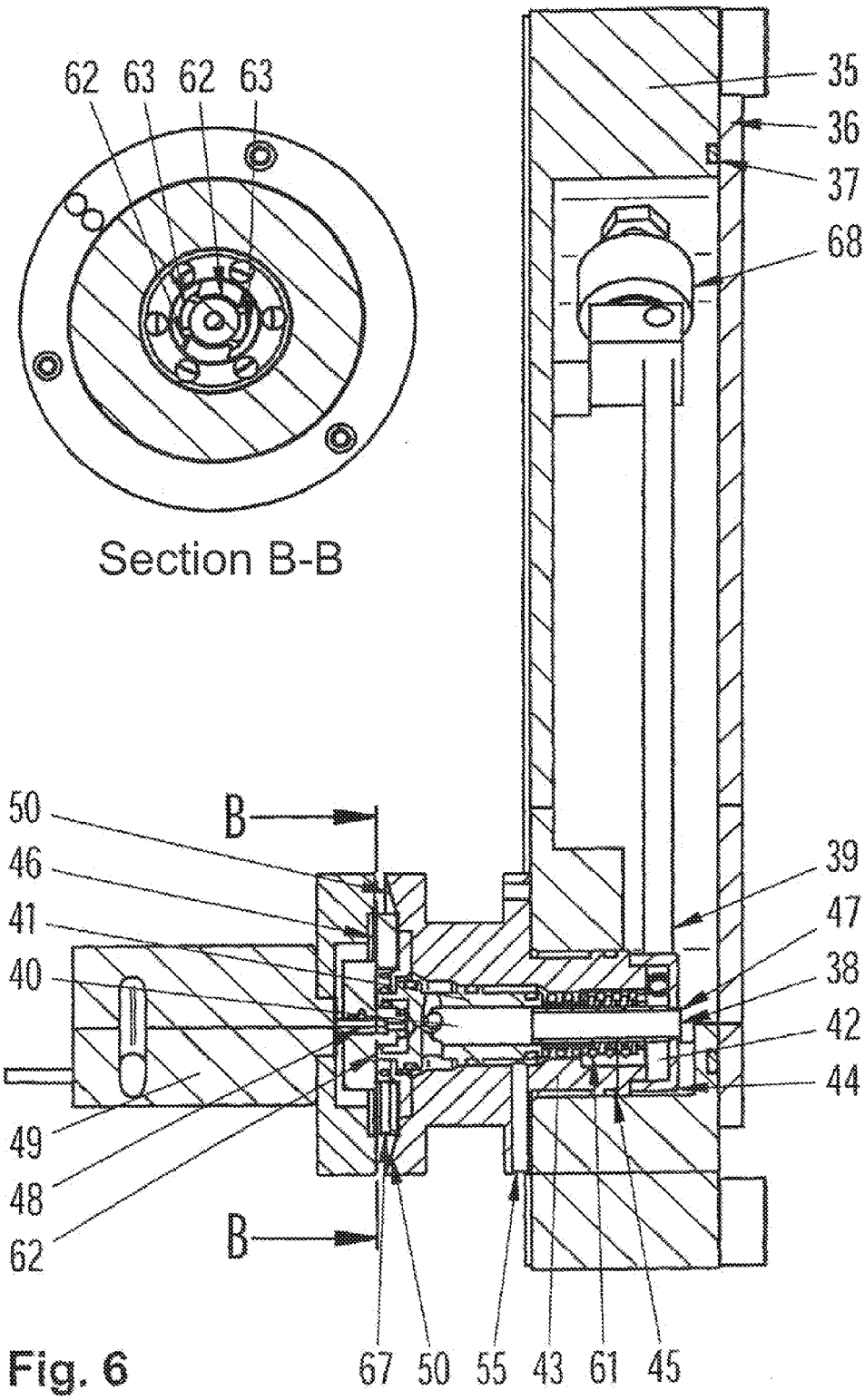
FIG. 6: shows the discharge appliance from FIG. 5, with the valve open and with the storage container emptied.
Figure 7:
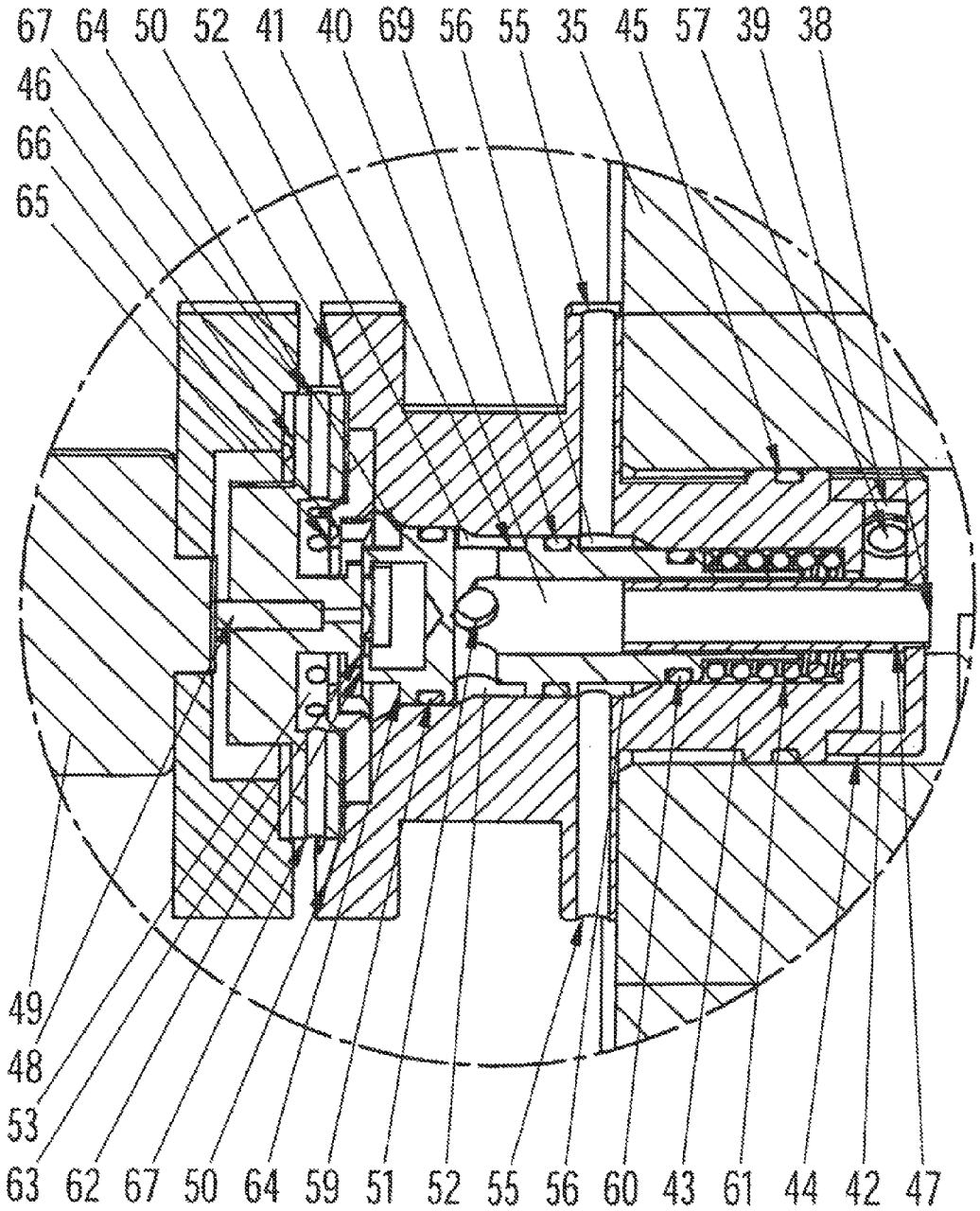
FIG. 7: shows an enlarged detail from FIG. 5 in the region of the valve.

In the exemplary embodiment illustrated in FIG. 5 to FIG. 8, the storage container 35 is in the form of a hollow parallelepiped which is sealed off by means of a cover 36 and O-ring 37. The safety liquid filling-level monitoring is implemented by a commercially available level sensor 68. In FIG. 5, the safety liquid level is above the level sensor 68, and in FIG. 6 it is below it. Further, the storage container has a safety liquid outlet orifice 38 and an air inlet tube 39 separate from this. The safety liquid outlet orifice 38 issues into a central bore 40 of the valve piston 41, and the air inlet tube 39 issues into a cavity 42 between the valve housing 43 and a pot 44. The valve housing 43 is screwed sealingly to the storage container 35, is sealed off by means of an O-ring 45 and issues into an atomizer wheel 46 at the end facing away from the storage container 35. The valve piston 41 is arranged displaceably in the valve housing 43 and has a central bore 40 into which projects a safety liquid tube 47 prolonging the safety liquid outlet orifice 38. The shaft 48 of the atomizer wheel 46 is driven by an electric motor 49. A baffle surface 50, which is inclined with respect to the longitudinal axis of the valve, is provided around the circumference of the atomizer wheel 46.

In the open state of the valve (see FIG. 8), the safety liquid passes from the storage container 35 through the safety liquid outlet orifice 38 and through the safety liquid tube 47 into the central bore 40 of the valve piston 41. It passes from the central bore 40 through radial bores 51 into the space 52 between the valve piston 41 and the valve housing 43, which space communicates with the inner space 53 of the atomizer wheel 46 in the open state of the valve. The path of the safety liquid which is described and is illustrated by the arrowed line 54 in FIG. 8 forms the liquid duct of the valve. At the same time, air passes through an air orifice 55 in the valve housing 43 into a space 56 between the valve housing 43 and the valve piston 41, which space communicates, in the open state of the valve, with a cavity 42 between the valve housing 43 and the pot 44 and the air inlet bore 57 and consequently with the air inlet tube 39 and the interior of the storage container 35. The path of the air which is described and which is illustrated by the arrowed line 58 in FIG. 8 forms the air inlet duct. The liquid duct and the air inlet duct are separated from one another by the O-ring 69, so that, during use, the safety liquid can be extracted from the storage container and the storage container can be ventilated at the same time, so that the safety liquid quantity per unit time can be kept approximately constant while the safety liquid is being discharged.

Figure 8:
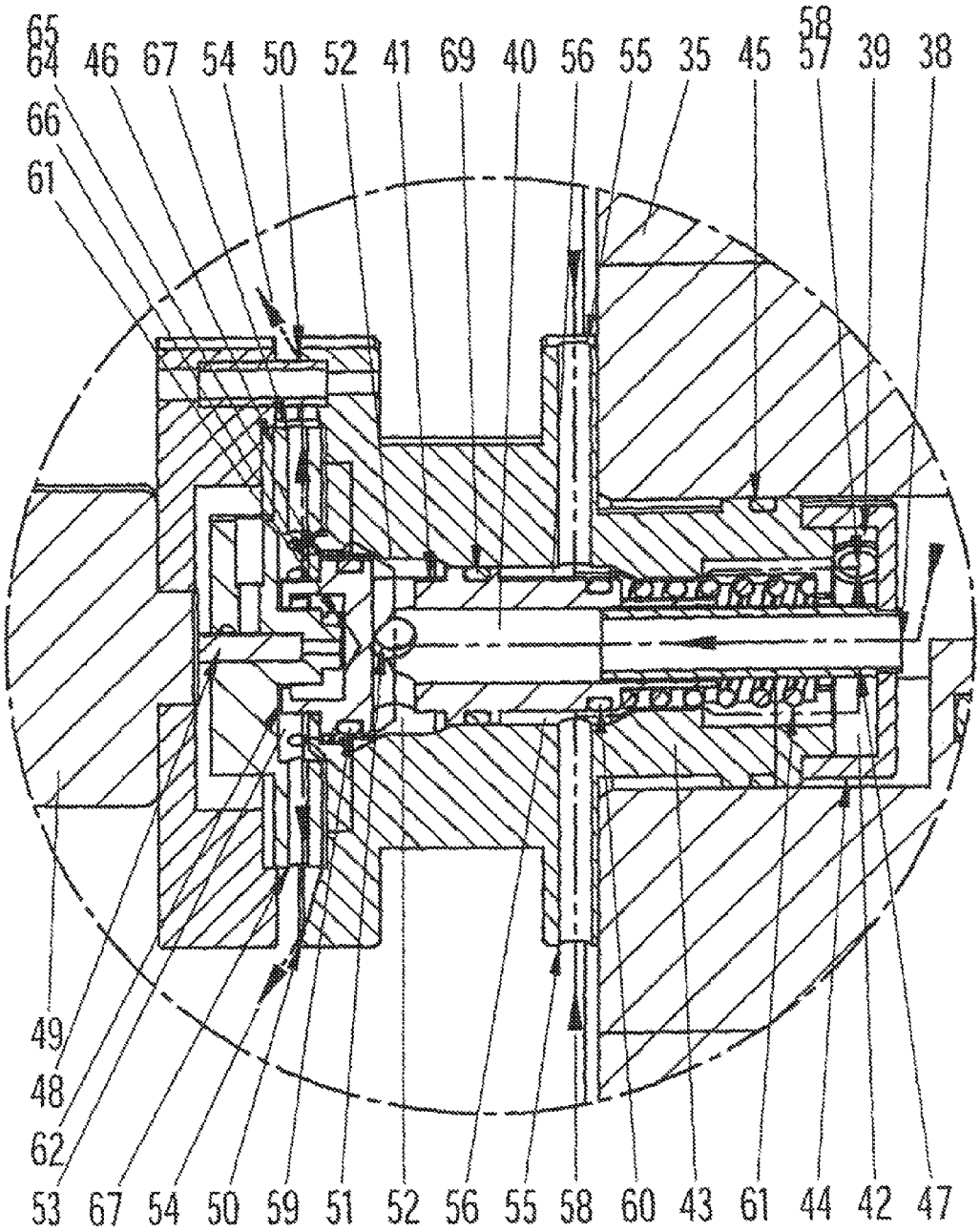
FIG. 8: shows an enlarged detail from FIG. 6 in the region of the valve.

In the closed state of the valve (see FIG. 7), the space 52 between the valve piston 41 and the valve housing 43 is closed by the O-rings 69 and 59 and communicates only with the radial bores 51, so that no safety liquid can pass out of the liquid duct in FIG. 8 into the inner space 53 of the atomizer wheel 46. At the same time, the space 56 between the valve piston 41 and the valve housing 43 is closed by the O-rings 69 and 60 and communicates only with the air orifices 55 in the valve housing 43, so that no air can pass through the air inlet duct in FIG. 8 into the air inlet tube 39 and consequently into the storage container 35. The position of the valve piston 41 with respect to the valve housing 43 ensures a permanently leaktight closure of the storage container 35.

In the discharge appliance according to the invention, as illustrated, the valve piston 41 in the valve designed as a slide valve can be displaced from its closed position (FIG. 5 and FIG. 7) into its open position (FIG. 6 and FIG. 8) by the electric motor 49. In the position of rest (FIG. 7), the valve piston 41 is prestressed by a spring 61 which, on the one hand, is supported on the valve housing 43 and, on the other hand, presses the valve piston 41 via its claws 62 onto the claws 63 of the atomizer wheel 46 which are oriented so as to overlap with these. During use, the electric motor 49, activated, for example, by a control unit, sets the atomizer wheel 46 in rotation. As soon as the claws 62 of the valve piston 41 are no longer supported on the claws 63 of the atomizer wheel 46, the valve piston 41 is displaced by the spring 61 in the direction of the electric motor 49 with respect to the valve housing 43, until its shoulder 64 bears against the holding surface 65 of the supporting disk 66 and is therefore in the open position (FIG. 8), in which the O-rings 59 and 60 lying on the circumference of the valve piston 41 are no longer in contact with the valve housing 43 and in which the liquid duct and the air inlet duct are therefore open. The safety liquid can therefore flow from the space 52 into the inner space of the atomizer wheel 46 and from there radially outward through the discharge orifices 67. The centrifugal force generated as a result of the rotation of the atomizer wheel 46 gives rise to a vacuum and sucks safety liquid out of the storage container 35. The safety liquid emerging from the discharge orifices 67 is atomized further as a result of impingement onto the baffle surface 50. At the same time, air can continue to flow through the air inlet duct into the storage container 35.

The invention claimed is:

1. A discharge device for safety liquids, comprising:

a slide valve having a valve piston and a valve body;

said slide valve fluidically connected to a safety liquid source and issuing into a distributor having discharge orifices formed therein and being a drivable atomizer wheel;

said valve piston and said valve body of said slide valve forming in air inlet duct therebetween;

said valve piston and said valve body of said slide valve forming a liquid exit duct therebetween;

said safety liquid source connected to said atomizer wheel via said liquid exit duct formed in said slide valve;

said air inlet duct of said slide valve being sealed off with respect to said liquid exit duct of said slide valve;

said slide valve having, dependent on a position of said valve piston with respect to said valve body, a closed state in which said liquid exit duct and said air inlet duct are closed and an open state in which said liquid exit duct and said air inlet duct are open.

2. The discharge device according to claim 1, wherein said safety liquid source contains a liquid solution selected from the group consisting of irritants, riot control and self-defense agents, markers, combinations thereof, fire-extinguishing agents, and preventive fire-fighting agents and said atomizer wheel is configured to discharge said liquid solution.

3. The discharge device according to claim 1, wherein said safety liquid source contains a liquid solution selected from the group consisting of oleoresin capsicum, a combination of (E)-2-butenylmercaptan (C4H7SH), 3-methylbutanethiol and corresponding S-acetyl compounds, dyes and fluorescent pigments, and combinations thereof, and said atomizer wheel is configured to discharge said liquid solution.

4. The discharge device according to claim 1, wherein said safety liquid source contains a safety liquid solution including 1,1,1,2,2,4,5,5,5-nonafluoro-4-(trifluoromethyl)-3-pentanone and said atomizer wheel is configured to discharge said safety liquid solution from said safety liquid source for fire-fighting or preemptive fire-fighting.

5. The discharge device according to claim 4, wherein said atomizer wheel is disposed to discharge into a switch cabinet.

6. The discharge device according to claim 1, which further comprises an electric motor for rotating said atomizer wheel.

7. The discharge device according to claim 1, which further comprises a baffle surface formed around a circumference of said atomizer wheel.

8. The discharge device according to claim 7, wherein said baffle surface is inclined with respect to an axis of rotation of said atomizer wheel.

9. The discharge device according to claim 1, wherein said atomizer wheel is formed with a run-on element configured to cooperate with a run-on surface on said valve piston in order to displace said valve piston during a rotation of said atomizer wheel.

10. The discharge device according to claim 1, wherein said atomizer wheel is formed with claws configured to cooperate with claws on said valve piston in order to displace said valve piston by the force of a spring during a rotation of said atomizer wheel.

11. A method of using a discharge device for discharging a safety liquid, which comprises providing a discharge device for a safety liquid, including:

a slide valve having a valve piston and a valve body;

said slide valve fluidically connected to a safety liquid source that supplies the safety liquid;

said slide valve issuing into a distributor having discharge orifices formed therein and being a drivable atomizer wheel;

said valve piston and said valve body of said slide valve forming in air inlet duct therebetween;

said valve piston and said valve body of said slide valve forming a liquid exit duct therebetween;

said safety liquid source connected to said atomizer wheel via said liquid exit duct formed in said slide valve;

said air inlet duct of said slide valve being sealed off with respect to said liquid exit duct of said slide valve;

said slide valve having, dependent on a position of said valve piston with respect to said valve body, a closed state in which said liquid exit duct and said air inlet duct are closed and an open state in which said liquid exit duct and said air inlet duct are open; and using the discharge device to discharge the safety liquid.

* * * * *